US005107992A

United States Patent [19]

Yang

[11] Patent Number: 5,107,992

[45] Date of Patent: Apr. 28, 1992

[54] ORNAMENT DISPLAYING HANGER

[76] Inventor: Ta-Chi Yang, 9F-3, No. 20, Sec. 1, Roosevelt Road, Taipei, Taiwan

[21] Appl. No.: 719,783

[22] Filed: Jun. 24, 1991

[51] Int. Cl.[5] ..... A47F 7/00

[52] U.S. Cl. ..... 211/13; 211/119; 211/181

[58] Field of Search ..... 211/13, 106, 119, 181; 248/690; 223/91

[56] References Cited

U.S. PATENT DOCUMENTS

| | | | |
|---|---|---|---|
| 589,737 | 3/1952 | Scott-Dalgleish | 211/119 |
| 780,608 | 1/1905 | Heath | 211/45 |
| 1,512,130 | 10/1924 | Pardue | 211/45 |
| 1,891,310 | 12/1932 | Hicks | 211/106 |
| 2,080,467 | 5/1937 | Feldman et al. | 211/45 |
| 3,967,766 | 7/1976 | Hart | 211/119 X |
| 4,132,316 | 1/1979 | Schmidt, Jr. | 211/13 |
| 4,852,777 | 8/1989 | Balben | 21/119 X |

*Primary Examiner*—David M. Purol
*Assistant Examiner*—Sarah A. Lechok
*Attorney, Agent, or Firm*—Notaro & Michalos

[57] ABSTRACT

An ornament displaying hanger comprising an upper rod and a lower rod with a gap therebetween to receive a displaying card therein. An opening which communicates with the gap is provided for inserting the displaying card into the gap. A plurality of expanded portions are formed on the lower rod for helping remove the card out of the hanger.

4 Claims, 1 Drawing Sheet

ORNAMENT DISPLAYING HANGER

FIELD OF THE INVENTION

The invention relates generally to a hanger for suspending an ornament displaying card.

BACKGROUND OF THE INVENTION

Personal ornaments or jewelry are usually small in size and are attached on paper or plastic cards for displaying. Although the paper or plastic cards are good in retaining the ornaments or jewelry, there is so far no way to display the paper cards, with jewelry thereon, except placing on a table.

SUMMARY OF THE INVENTION

It is therefore an object of the present invention of provide an ornament; displaying hanger which is able to suspend an ornament displaying card with ornaments thereon.

It is another object of the present invention to provide an ornament displaying hanger wherein the displaying card suspended thereon is easy to be taken out of the hanger.

To achieve the above objects, there is provided an ornament displaying hanger comprising an upper rod and a lower rod with a gap therebetween to receive a displaying card therein. An opening which communicates with the gap is provided for inserting the displaying card into the gap. A plurality of expanded portions are formed on the lower rod for helping remove the card out of the hanger.

Other and further features, advantages and benefits of the invention will become apparent in the following description taken in conjuction with the following drawings. It is to be understood that to the foregoing general description and the following detailed description are exemplary and explanatory but are not to be restrictive of the invention.

DETAILED DESCRIPTION OF THE PREFERRED ENBODIMENT

Figure 1:
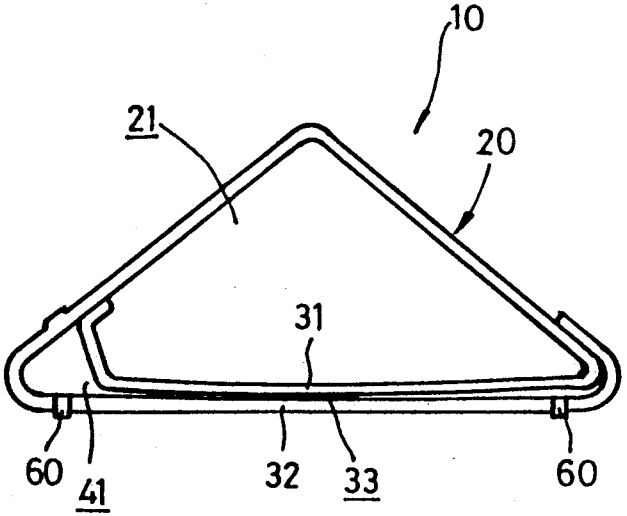
FIG. 1 is a planar view showing an ornament displaying hanger in accordance with the present invention.

With reference to the drawings and in particular to FIG. 1, an ornament displaying hanger in accordance with the present invention, generally designated by the reference numeral 10, comprises a triangular body 20 which forms an interior space 21 for hanging on a projection (not shown) with a vertex thereof, and an upper rod 31 and a lower rod 32 which are attached to the body 20 to partially constitute the triangle. The upper rod 31 and the lower rod 32 ar close to each other with a gap 33 formed therebetween. An opening 41 which communicates with the gap 33 is formed by bending one end of the upper rod 31 upwards to help inserting a card 50 (FIG. 2) in to the gap 33. The gap 33 is so dimensioned that when the card 50 is inserted thereinto, the upper rod 31 and the lower rod 32 pinches the card 50. To increase the pinching force, the upper rod 31 is slightly concave so that the gap 33 is smallest is the middle portion. The ornament displaying hanger 10 is preferably made of flexible material.

Figure 2:
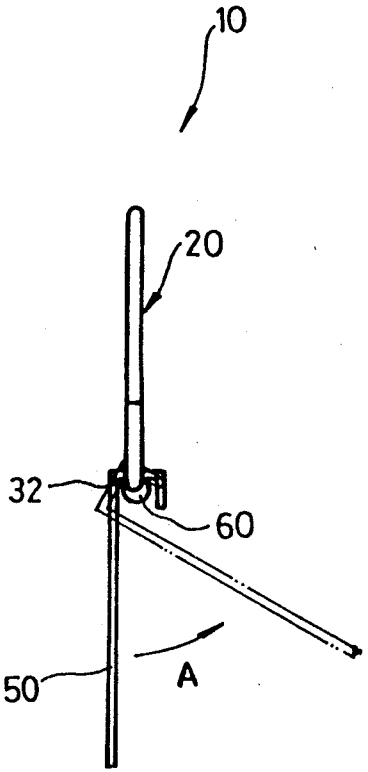
FIG. 2 is a side elevational view of the ornament displaying hanger shown in FIG. 1.

Further referring to FIG. 2, when the card 50 is inserted into the gap 33, and slightly adjusted, it will be seen as that shown by the solid line in FIG. 2. To remove the card 50 out of the gap 33, a plurality of expanded portions 60, preferably two, are formed on the lower rod 32. The expanded portions 60 are generally protruding downwards so that when the card 50 is rotated along arrow A about the lower rod 32 (as that shown by dashed line in FIG. 2), the expanded portions 60 serves as the fulcrum of a lever to push the upper rod 31 upwards and thus allowing the card 50 to be pull out of the gap 33.

The invention herein has been described in an illustrative manner and it is understood that the description of the preferred embodiments is for the purposes of illustration, rather than limitation. It is to be understood that the invention may be practiced otherwise than as specifically described herein and yet remains within the scope of the appended claims.

What is claimed is:

1. An ornament displaying hanger comprising a triangular body which forms an interior space for hanging on a projection with an vertex thereof and an upper rod and a lower rod which are close to each other with a gap therebetween and are attached to said body to constitute a side of said triangle, both said body and said rods being preferably made of flexible material, an opening being formed by bending one end of said upper rod upwards, said opening communicating with said gap so as to help insert a display card into said gap, said gap being so dimensioned that when said card is inserted thereinto, said rods pinch said card therebetween.

2. An ornament displaying hanger as claimed in claim 1 wherein said upper rod is concave to make said gap smallest in the middle and thus increase the pinching force between said upper rod and said lower rod.

3. An ornament displaying hanger as claimed in claim 1 further comprising a plurality of expanded portions formed on said lower rod, said expanded portions being formed by protruding downwards so that when said card which is pinched between said upper and lower rods is rotated about said lower rod, said expanded portions serve as a fulcrum of a lever constituted by said card to push said upper rod upwards and allow said card to be pulled out of said gap.

4. An ornament displaying hanger as claimed in claim 3 wherein the number of said expanded portions is preferably two.

* * * * *